US005473703A

United States Patent [19]

Smith

[11] Patent Number: 5,473,703

[45] Date of Patent: Dec. 5, 1995

[54] METHODS AND APPARATUS FOR CONTROLLING THE FEED RATE OF A DISCRETE OBJECT SORTER/COUNTER

[75] Inventor: Timothy R. Smith, Stamford, Conn.

[73] Assignee: Kirby Lester, Inc., Stamford, Conn.

[21] Appl. No.: 61,305

[22] Filed: May 13, 1993

Related U.S. Application Data

[63] Continuation-in-part of Ser. No. 662,418, Feb. 28, 1991, Pat. No. 5,317,654.

[51] Int. Cl.[6] ..... G07F 11/00

[52] U.S. Cl. ..... 382/143; 221/200

[58] Field of Search ..... 382/1, 8; 209/920, 209/921; 221/200, 201; 235/476, 475; 198/341; 364/478, 555, 455

[56] References Cited

U.S. PATENT DOCUMENTS

| | | | |
|---|---|---|---|
| 3,746,211 | 7/1973 | Burgess | 221/200 |
| 3,823,844 | 7/1974 | Linkemer et al. | 221/200 |
| 3,915,292 | 10/1975 | Brown | 221/200 |
| 4,354,618 | 10/1982 | Weyandt | 221/186 |
| 4,440,288 | 4/1984 | Thomas et al. | 198/460 |
| 4,662,053 | 5/1987 | Aceti et al. | 221/200 |
| 4,885,784 | 12/1989 | Miyagawa et al. | 382/8 |

OTHER PUBLICATIONS

Brochure & operating instruction for The KL25 Tablet Counter by Kirby Lester Incorporated, Copyright 1992.
Brochure & operating instruction for the KL50 Tablet Counter by Kirby Lester Incorporated, Copyright 1990.
Brochure & operating instructions for the KL100 Tablet Counter by Kirby Lester Incorporated, Copyright 1990.

*Primary Examiner*—Leo H. Boudreau
*Assistant Examiner*—Chris Kelley
*Attorney, Agent, or Firm*—David P. Gordon

[57] ABSTRACT

An object sorter/counter for controlling the feed rate of a sorter/counter includes a feed bowl which is oscillated by an adjustable amplitude vibrator and an exit assembly having a chute with a sensor array for registering the passage of objects through the exit assembly. The feed bowl is provided with a shutter which interposes a photodetector and a light source so that light from the light source is blocked from detection by the photodetector intermittently as the feed bowl oscillates. A circuit coupled to the photodetector generates a series of pulses having widths inversely proportional the amplitude of bowl oscillation. A controller adjusts the vibrator to oscillate the feed bowl at a predetermined amplitude until the sensor array senses a first object. The controller then adjusts the vibrator to oscillate the feed bowl at a lower amplitude and monitors the sensing of other objects. Time intervals between objects being sensed are monitored and the controller adjusts the vibrator to oscillate the feed bowl at a lower or higher amplitude to maintain a constant feed rate. A count of objects sensed is maintained and compared to a predetermined maximum count. When the count of objects equals a predetermined number less than the maximum count, the controller adjusts the vibrator to oscillate the feed bowl at a lower amplitude to lower the feed rate. When the count of objects equals the maximum count, the controller activates a gate closing the chute.

10 Claims, 12 Drawing Sheets

CONTROL MODULE

FIRST PILL MODULE

METHODS AND APPARATUS FOR CONTROLLING THE FEED RATE OF A DISCRETE OBJECT SORTER/COUNTER

This application is a continuation-in-part of application Ser. No. 07/662,418 filed Feb. 28, 1991, now U.S. Pat. No. 5,317,654, for "Method and Apparatus for the Recognition and Counting of Discrete Objects".

BACKGROUND OF THE INVENTION

1. Field of the Invention

The present invention relates to object sorters and counters such as tablet or pill sorting or counting devices. More particularly, the invention relates to a method and apparatus for controlling the amplitude of oscillation and the feed rate of an oscillating object sorter or counter.

2. State of the Art

Object sorters and counters including those using oscillation or vibratory motion are well known in the art. These types of devices all share the common goal of reducing a collection of discrete objects to an orderly line of flow so that they may be sorted and/or counted as they move past one or more optical sensors. Such devices take various forms including rotational and linear vibrators, rotating discs, air jets, gravity feeds, moving belts, etc. The vibrating devices generally include an input hopper or bowl and various funnels, chutes, or channels, one or more of which are vibrated by vibrator coils so as to direct the objects into one or more single-file lines of flow. It is recognized that the amplitude of vibration is important in controlling feed rate and that a controllable feed rate is desirable.

Several methods and devices are now used to control the feed rate of vibrating object sorters and counters. A typical manner of controlling the feed rate in the prior art is to manually adjust and set a controller that will send pulses of constant duration to a vibrator. Such a manual adjustment will result in a constant rate of vibration and a constant feed rate so long as other conditions affecting feed rate remain constant.

A typical controller is shown in prior art FIG. 1. When power line voltage is applied across nodes L1 and L2, and switch S1 is closed, current tries to run through the load (vibrator coils) which is connected to nodes H1 and H2, but is blocked by a silicon controlled rectifier (SCR) which has not been triggered. When the voltage at node L1 is positive, a trickle current flows through resistor R1 and user adjustable potentiometer R4, tending to charge capacitor C1. Diode D1 is chosen not to conduct below a nominal 8 volts and diode D2 is reverse biased. Therefore, the charging rate of capacitor C1 is determined by R1 and the manual setting of R4. D4 is a four layer diode which not only blocks reverse current flow, but also blocks forward current until a critical voltage is reached. At the critical voltage, D4 acts a short circuit and it will continue to conduct as long as current is supplied. Therefore, capacitor C1 continues to charge until the voltage across it (and across D1) reaches approximately 8 volts. Upon reaching 8 volts, D1 becomes a closed switch and C1 discharges (through D1, R2, R3, and the SCR gate circuit) to the "break-back" voltage of D1. Since not enough current can flow through R1 and R4 to keep D1 conducting, it recovers when C1 is discharged. The discharge current from C1 flows through R2 (which limits it to about 80 milliamperes) and splits between R3 and the gate (triggering) circuit of the SCR. This fires the SCR which then "holds" its conductivity after the trigger is gone. The SCR continues to conduct until its forward current drops below its minimum holding value. Since the supply for the triggering circuit is the voltage developed across the SCR, this supply disappears when the SCR turns on, preventing C1 from recharging during the rest of the positive half cycle. When L1 is negative, D2 becomes forward biased shunting C1 and preventing its charging to a negative voltage. Thus at the beginning of each positive half cycle, the voltage across C1 starts near zero and rises toward +8 volts. The sooner it reaches +8 volts, the longer the SCR conducts and consequently, the higher the vibration rate (and hence feed rate). The values of C1, R1, and R4 are chosen so that the SCR cannot fire much before the 90 degree phase angle of the power line. Varistor R5 absorbs voltage spikes to protect the SCR. A minimum holding current resistor R6 shunts the vibrator coils. When the SCR is triggered, its current must rise above the holding current value before the trigger pulse dies out. If the inductance of the vibrator coils does not let the current rise fast enough, R6 provides the needed extra holding current.

As mentioned above, at a given setting, the known controllers such as shown in FIG. 1 provide for a constant rate of pulses to the vibration coils and therefore the system provides a constant feed rate so long as other conditions affecting the feed rate remain constant. Unfortunately, other conditions affecting feed rate do not remain constant and the user must frequently re-adjust the controller if optimal feed rate is desired. Conditions which affect the feed rate include the feeder load, the type of objects being handled, and the condition of the feeder itself. Mechanical variations in the feeder result in varying responses to an otherwise constant power input. For example, as the equipment ages, parts of the feeder wear. Fastener clamp forces relax, springs fatigue, etc. These mechanical changes in the feeder cause it to vibrate and thus feed at a different rate even though the amount of power applied to the vibrator coils remains constant. Another important factor which affects feed rate is temperature. As the feeder operates, the vibrator coils dissipate heat, heating the driver and changing the spring rates of the springs. This changes the amplitude of vibration for a given power input.

Servo controllers such as the one shown in prior art FIG. 2 have been applied to vibrators to correct for the conditions which tend to vary the vibration amplitude. The basic functioning of the servo controllers are the same as the aforementioned controllers except for the elimination of the adjustment potentiometer and the substitution of a lower valued resistor in the C1 charging circuit. This results in a tendency for the SCR to run wide open. The output of the controller is reduced to operational levels by adding a conductor across nodes B1 and B2. This diverts some (or all) of the charging current to capacitor C1 and thus delays the firing time of the SCR. If the conductor across B1 and B2 is a closed switch, the SCR will not fire at all. For normal running, a Photoelectric Transducer (PET) is connected across nodes B1 and B2. The conducting element in the PET is a photo-transistor D whose conductivity is varied by the amount of light conveyed from a juxtaposed light-emitting-diode (LED), powered from terminal E. When the full illumination of the LED falls on the photo-transistor, it conducts enough to turn off the controller completely. When the photo-transistor is darkened, the controller runs full on, thus providing control over the entire output range of the controller.

As shown in prior art FIGS. 3 and 4, the PET is attached to the non-moving end-plate of a vibrator V, and a shutter S is attached to the moving end-plate and located so that it can block the light from the LED of the PET. The shutter is set so that it blocks the light when the vibrator is standing still. Thus, when the controller is turned on, it tends to run wide open. This in turn causes the moveable end-plate of the vibrator to move the shutter and allow light to strike the phototransistor, which cuts down the drive. Equilibrium is established in one or two cycles of the power line frequency. At equilibrium, the vibrator vibrates at the power line frequency and the shutter covers and uncovers the phototransistor once each cycle. When the power line voltage crosses the zero-axis (going positive), the photo-transistor is dark and C1 is charging rapidly. Later in the cycle, the shutter starts to uncover the photo-transistor and the charging of C1 is slowed. The resultant late firing of the SCR cuts down on the vibratory amplitude. For low amplitude operation, the shutter is mechanically set so that it barely covers the photo-transistor and a small excursion of the vibrator is sufficient to cut back the drive. For high amplitude operation, the shutter is mechanically set so that it overlaps the photo-transistor by a wider margin, thus forcing a larger excursion before the regulating action of the photo-transistor becomes effective. Transistor, Q1 connected across nodes B1 and B2, in normal operation, is biased to a non-conducting state and has no effect. Turn-on current is provided through Zener Diode Z1, which does not conduct below a nominal 5.1 volts. Since it derives its voltage source across the LED in the PET, and since normal voltage across the LED cannot exceed 1.7 volts, it is never high enough to pass current through Z1. If the LED is unplugged, disconnected or burned out however, the voltage input to Z1 exceeds 5.1 volts, Z1 conducts, and Q1 turns on. This robs C1 of all of its charging current and shuts off the controller.

The known servo controllers such as the one described above with reference to FIG. 2 have an important disadvantage. It is recognized that the position (exact edge location) of the shutter is critical for correct control of the vibrator. The position of the shutter edge, however, is subject to misalignment by shocks that might occur for instance during shipment of the equipment and even by the operation of the equipment. As a result, the vibration and feed rates are undesirably altered from initial settings. This problem is partially overcome in the art by incorporating a feedback system which adjusts the vibration rate as a function of the product counting rate. However, it will be appreciated that prior to the product being sensed and counted, vibration amplitude is uncertain, resulting in unoptimized feed for the initial portion of the product flow stream and hence potential counting inaccurracies. This problem is especially acute where critical tablet image data is collected by a sensor array at the start of a feed run. As described in the parent application, such critical data is used to arrive at an accurate count during the rest of the feed run. Failure to start the feed run at the desired rate thus jeopardizes the accuracy of the entire run.

SUMMARY OF THE INVENTION

It is therefore an object of the invention to provide an improved method for controlling the vibration rate and thus the feed rate of a vibrating object sorter/counter which does not rely on the precise location of the edge position of a photoelectric shutter.

It is also an object of the invention to provide a reliable means for the user to adjust the feed rate without requiring mechanical adjustment of the position of a photoelectric shutter.

It is another object of the invention to provide a photoelectric shutter having a narrow slot or aperture for triggering an optical sensor.

It is a further object of the invention to provide a photoelectric transducer which generates a pulse train output where the width of the pulses is inversely proportional to vibration amplitude.

It is yet another object of the invention to provide a controllable reference pulse train and means for comparing the width of the reference pulses to the width of the pulses generated by the transducer.

It is a still another object of the invention to provide an electronic means for adjusting the rate of vibration based on the comparison of pulse widths of reference pulses and pulses generated by the transducer.

A further object of the invention is to begin the feeding of objects in a timely but controlled fashion, to maintain a controlled feed rate during counting and to stop feeding when a preselected number of objects have been counted/sorted.

In accord with these objects which will be discussed in detail below, the methods and devices of the present invention are applied to a vibrating bowl counter for counting pharmaceutical objects such as tablets, capsules, caplets, and the like ("pills"). The vibrating bowl counter includes an input bowl hopper having a spiral ramped interior. The bowl is mounted on a frame including one or more vibrators which cause the bowl to vibrate in such a manner that a plurality of pills deposited into the bowl are vibrated by centripetal force so that they assume a single file path along the spiral ramp interior of the bowl to an exit opening at an upper peripheral region of the bowl. Upon exiting the bowl, the pills fall past a sensor array which counts the arrival of each pill. The bowl is coupled to a shutter which triggers a photoelectric transducer. The transducer includes an optical source and an optical sensor and the shutter is interposed between the source and sensor. Horizontal movement of the shutter causes the transducer to generate a pulse train wherein the width of the pulses is inversely proportional to the amplitude of bowl vibration. A control circuit compares reference pulses to the pulses generated by the transducer and adjusts the power to the vibrator(s) such that the vibration amplitude of the bowl is optimized prior to pill arrival. In addition, the control system monitors the arrival of the first pill at the sensor array and the rate at which pills pass the sensor array, and adjusts the amplitude of the vibrators accordingly.

Preferred aspects of the invention include: forming the shutter with a narrow slit so that light is allowed to fall on the photo detector only when the slit moves over it; providing the transducer with a guide sleeve and designing the shutter to fit within the guide sleeve of the transducer so that vertical movement of the shutter with respect to the light source and photo detector is limited; and providing a calibration circuit with an adjustable train of reference pulses and comparing them to the pulse train generated by the transducer to generate a signal each time the amplitude of bowl vibration (as indicated by the width of pulses from the transducer) exceeds a calibration setpoint (as indicated by the width of the reference pulse).

In accord with another preferred aspect of the invention, a microprocessor circuit with associated software is provided to control the operation of the sorter/counter according to signals generated by the calibration circuit as well as according to other signals from the sorter/counter such as the registration of the first pill delivered. The microprocessor calculates the number of pills counted, the average time interval between pill counts (i.e., the feed rate), and other parameters, and uses these calculations in order to maintain a constant feed rate during counting, as well as to slow down the feed rate before gate closing or turn-off.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
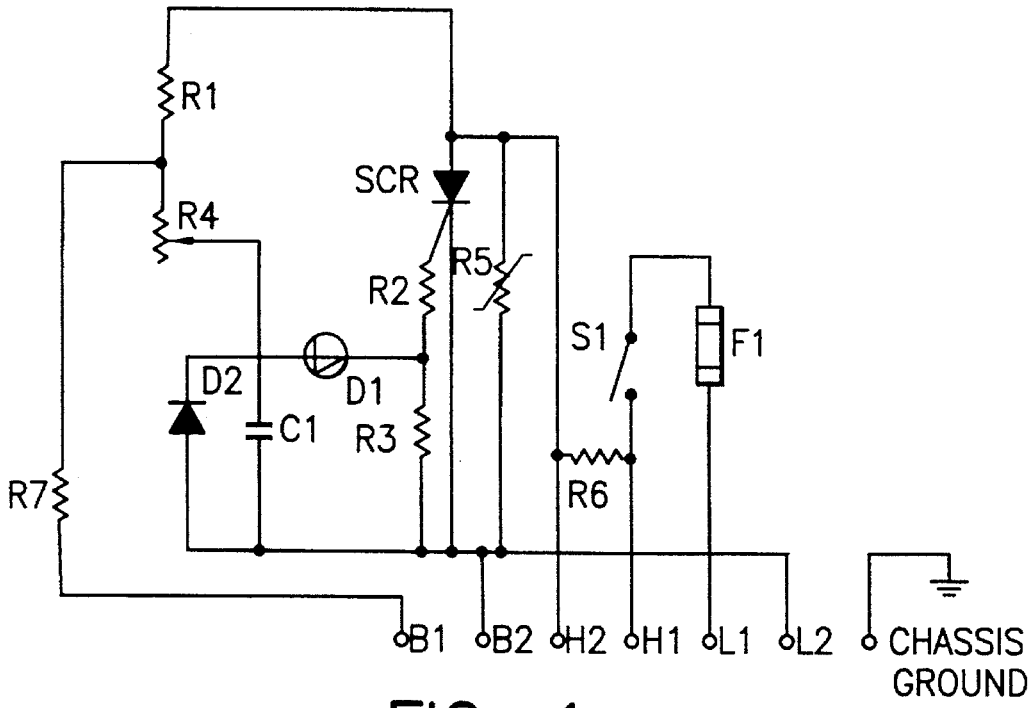
FIG. 1 PRIOR ART
FIG. 1 is a schematic diagram of a prior art manual controller circuit for a vibrator.
Figure 2:
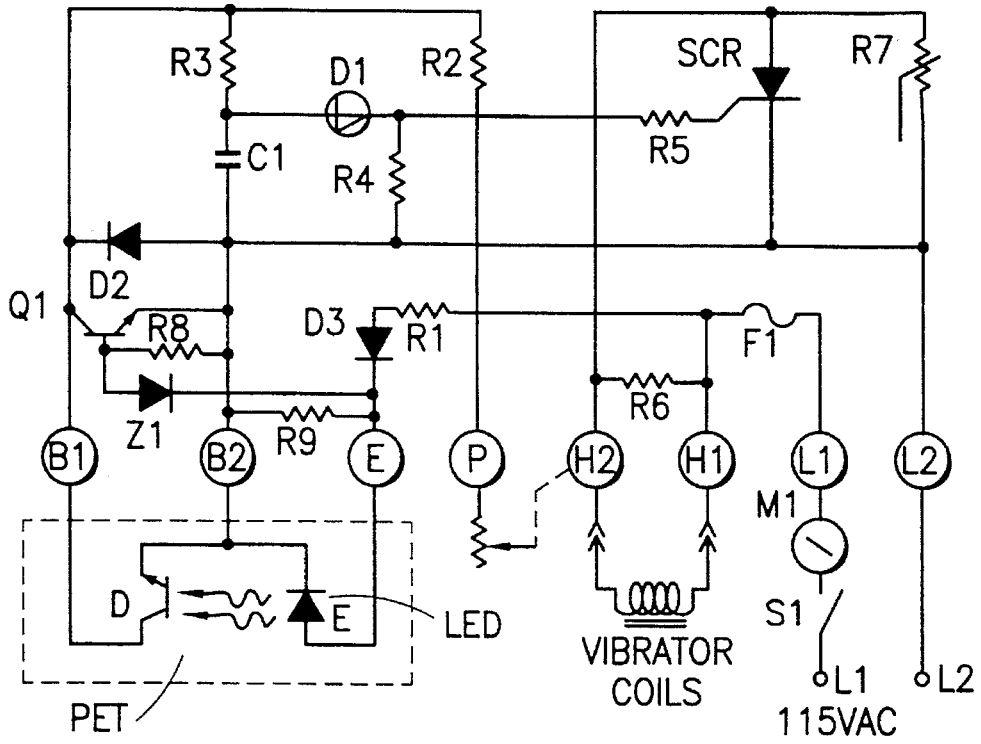
FIG. 2 PRIOR ART
FIG. 2 is a schematic diagram of a prior art servo controller circuit for a vibrator.
Figure 4:
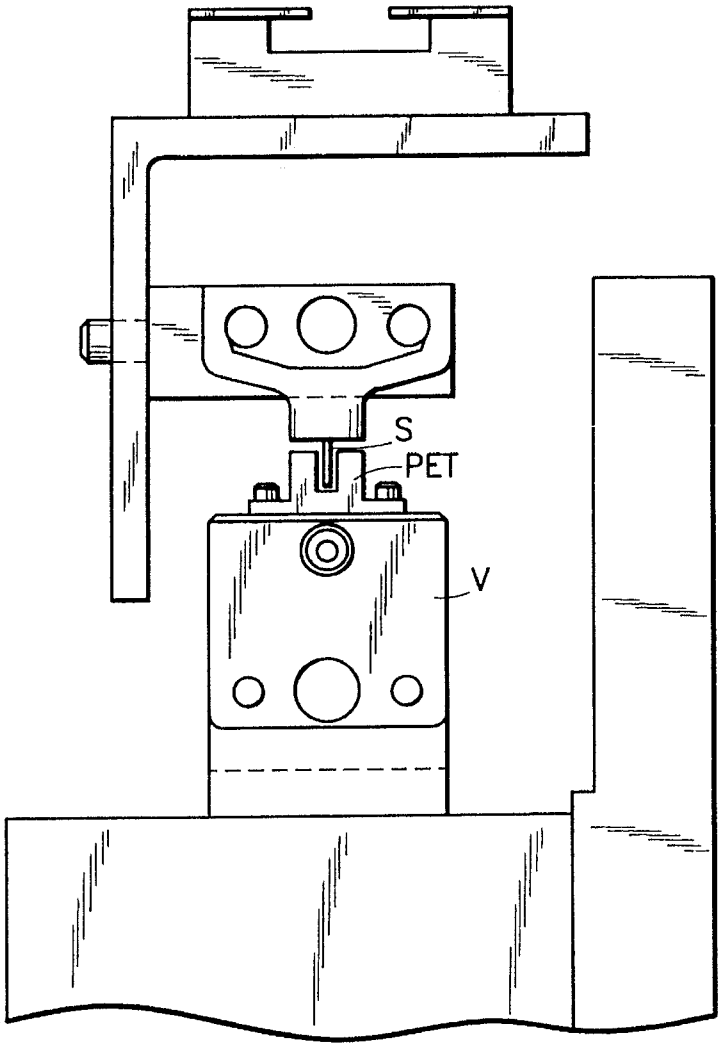
FIG. 4 PRIOR ART
FIG. 4 is an end view of the prior art vibrating sorter/counter of FIG. 3.
Figure 3:
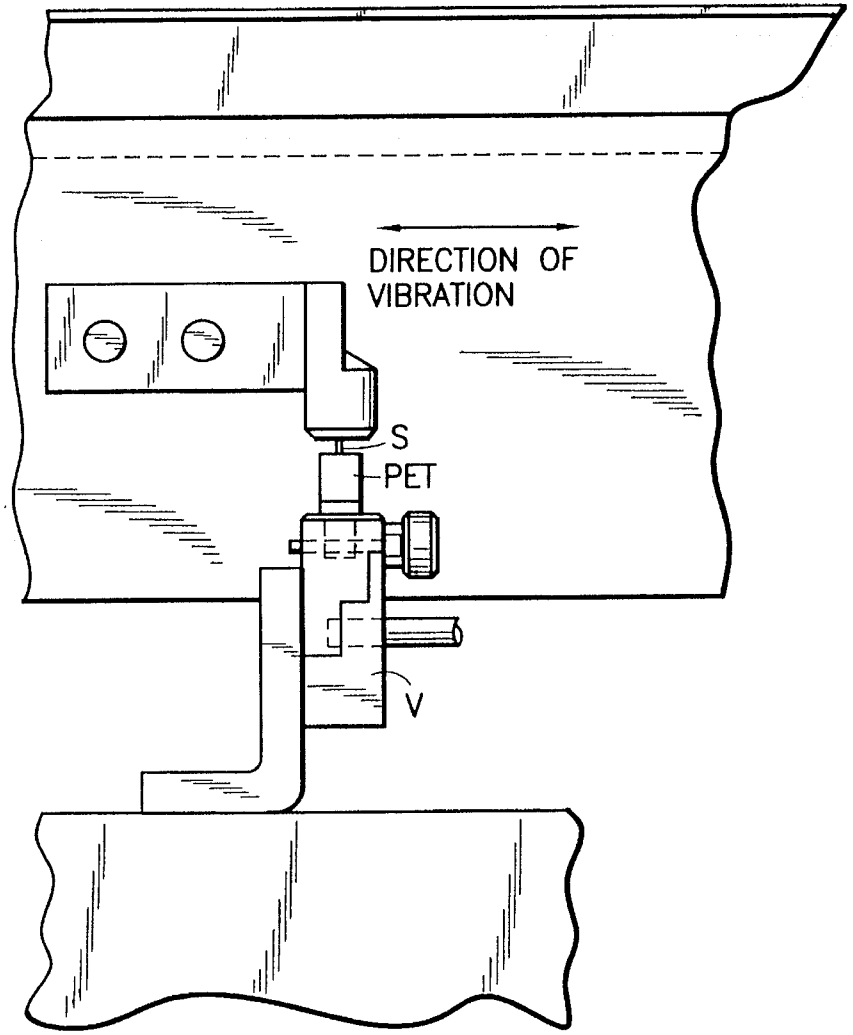
FIG. 3 PRIOR ART
FIG. 3 is a side elevation view of a portion of a prior art vibrating sorter/counter with a photoelectric transducer for use with the servo controller of FIG. 2.
Figure 5:
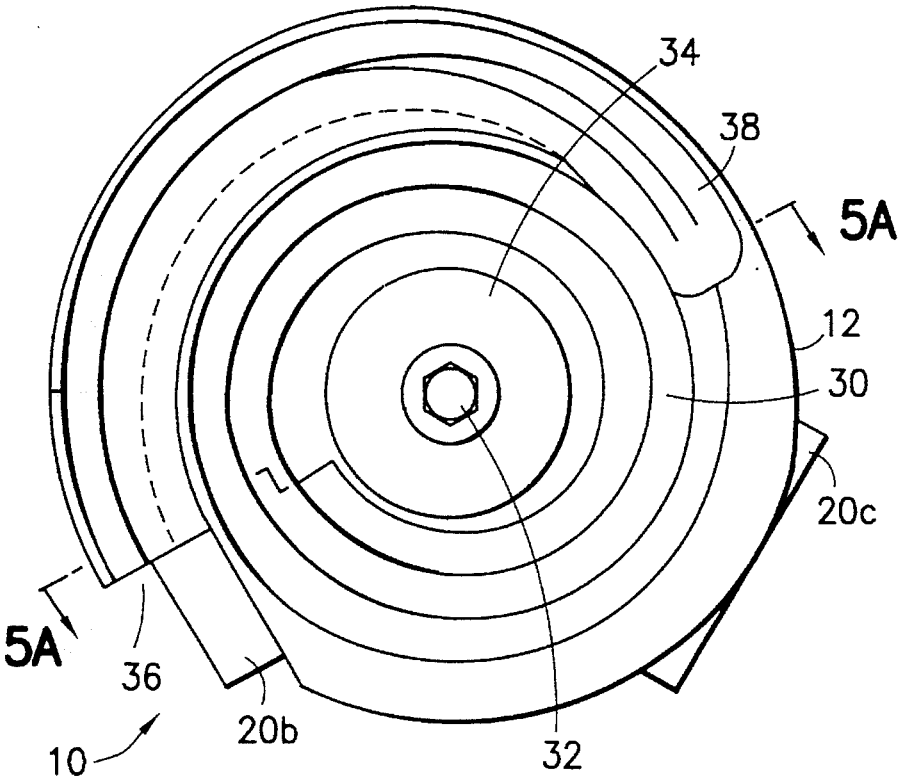
FIG. 5 is a top view of the input feed bowl of a vibrating sorter/counter according to the invention.
Figure 5A:
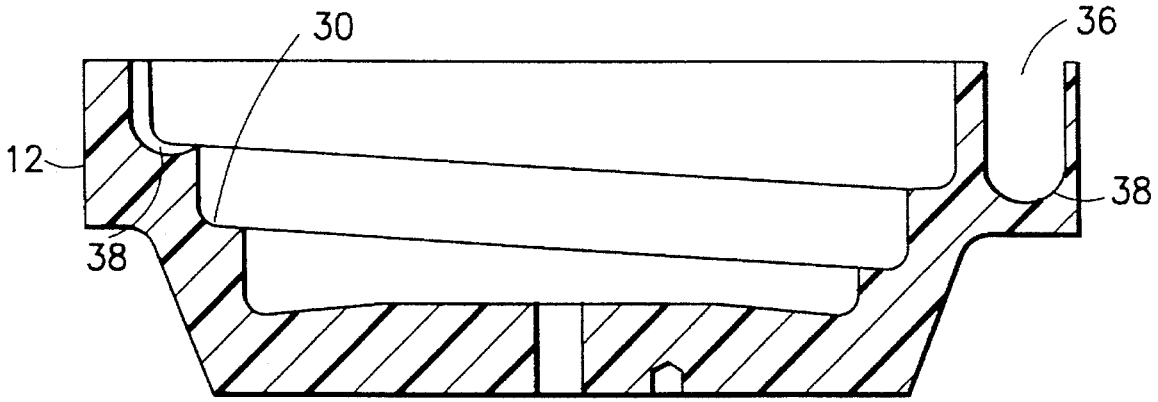
FIG. 5*a* is a cross section through line A—A in FIG. 5.
Figure 6:
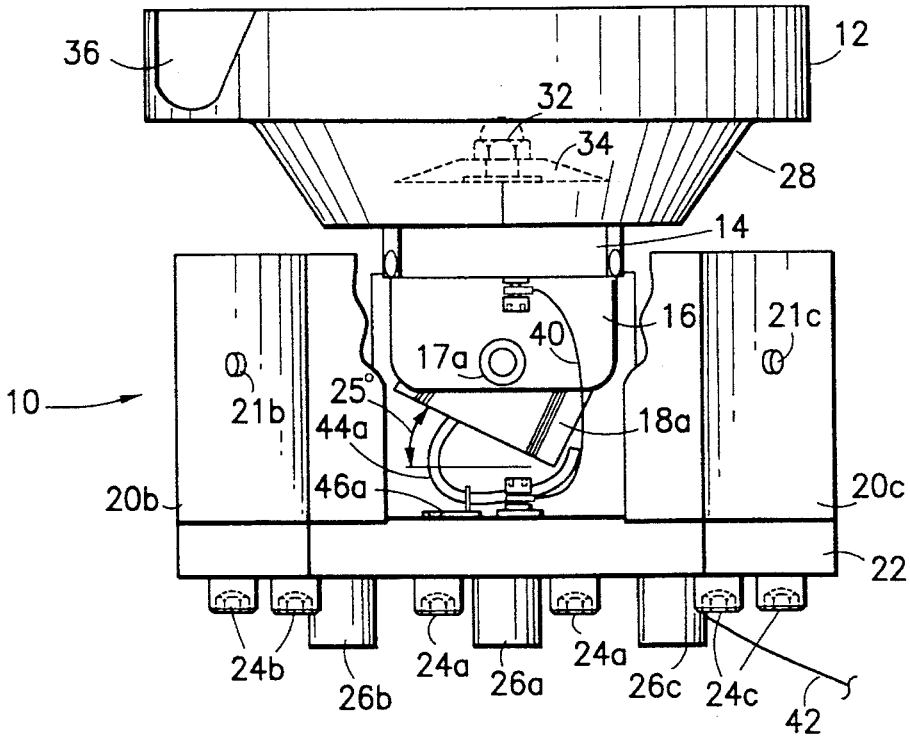
FIG. 6 is a side elevation view of the input feed bowl of the vibrating sorter/counter of FIG. 5.
Figure 7:
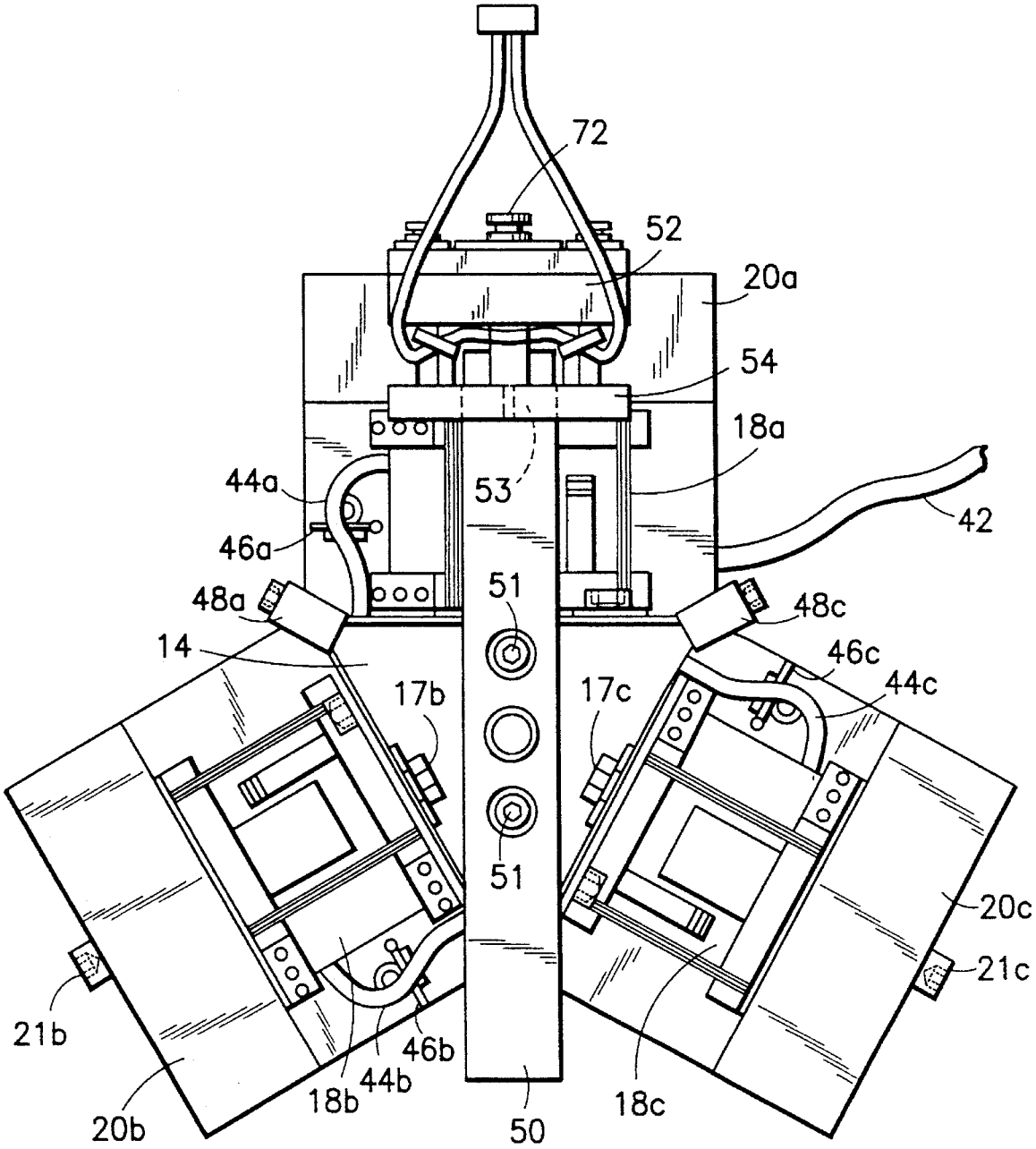
FIG. 7 is a top view of the vibrating sorter/counter with the feed bowl removed.

Referring now to FIGS. 5–7, the feeder portion 10 of the invention generally comprises a preferably plastic feeder bowl 12 which is coupled to a mounting plate 14 which is mounted by a D-spring 16 to three vibrators 18*a*–18*c*. Vibrators 18*a*–18*c* are mounted on respective inertia blocks 20*a*–20*c* by screws 21*a*–21*c* which in turn are mounted on a tripod 22 by respective pairs of bolts 24*a*–24*c*. The tripod 22 is supported by shock mounts 26*a*–26*c*.

Bowl 12 is provided with a generally conical section within which a spiral ramp 30 is formed. The bowl 12 is coupled to the mounting plate 14 by a central bolt 32 and a clamp washer 34. In the particular embodiment of FIGS. 5–7, the spiral ramp 30 winds counter-clockwise from the center of the bowl 12 adjacent clamp washer 34 upward and outward to an exit opening 36 near the upper periphery of the bowl 12. The last half turn of the ramp dips into a roughly semi-circular trough 38. The bowl 12 may be covered by a cover plate (not shown) to prevent objects from spilling out of the bowl as they travel up the ramp 30 before exiting at opening 36. Mounting plate 14 is preferably provided with a grounding strap 40 which electrically couples the clamp washer 34 to the tripod 22. The tripod 22 is similarly provided with a grounding strap 42 which electrically couples the tripod to a baseplate (not shown). D-spring 16 supporting mounting plate 14 is coupled to vibrators 18*a*–18*c* by screws 17*a*–17*c* respectively.

Vibrators 18*a*–18*c* are preferably mounted on inertia blocks 20*a*–20*c* at an angle (e.g., 25°) to the horizontal plane defined by tripod 22 so as to cause an upward and forward movement of pills. Vibrator power cables 44*a*–44*c* are held to respective inertia blocks 20*a*–20*c* by thin wire ties 46*a*–46*c*. Tuning weights 48*a*–48*c* are mounted between respective vibrators as needed to achieve mechanical resonance at a desired frequency.

One of the inertia blocks 20*a* supports a photoelectric transducer assembly 52 (described in detail below with reference to FIGS. 8*a*–8*c*) which is attached to inertia block 20*a* by screws 54. A photoelectric shutter 50 (described in detail below with reference to FIGS. 9*a*–9*c*) is connected to mounting plate 14 by screws 51. One end 53 (shown and described in detail below) of the shutter 50 extends into and is received by the transducer 52 as will be described in detail below.

Figure 6A:
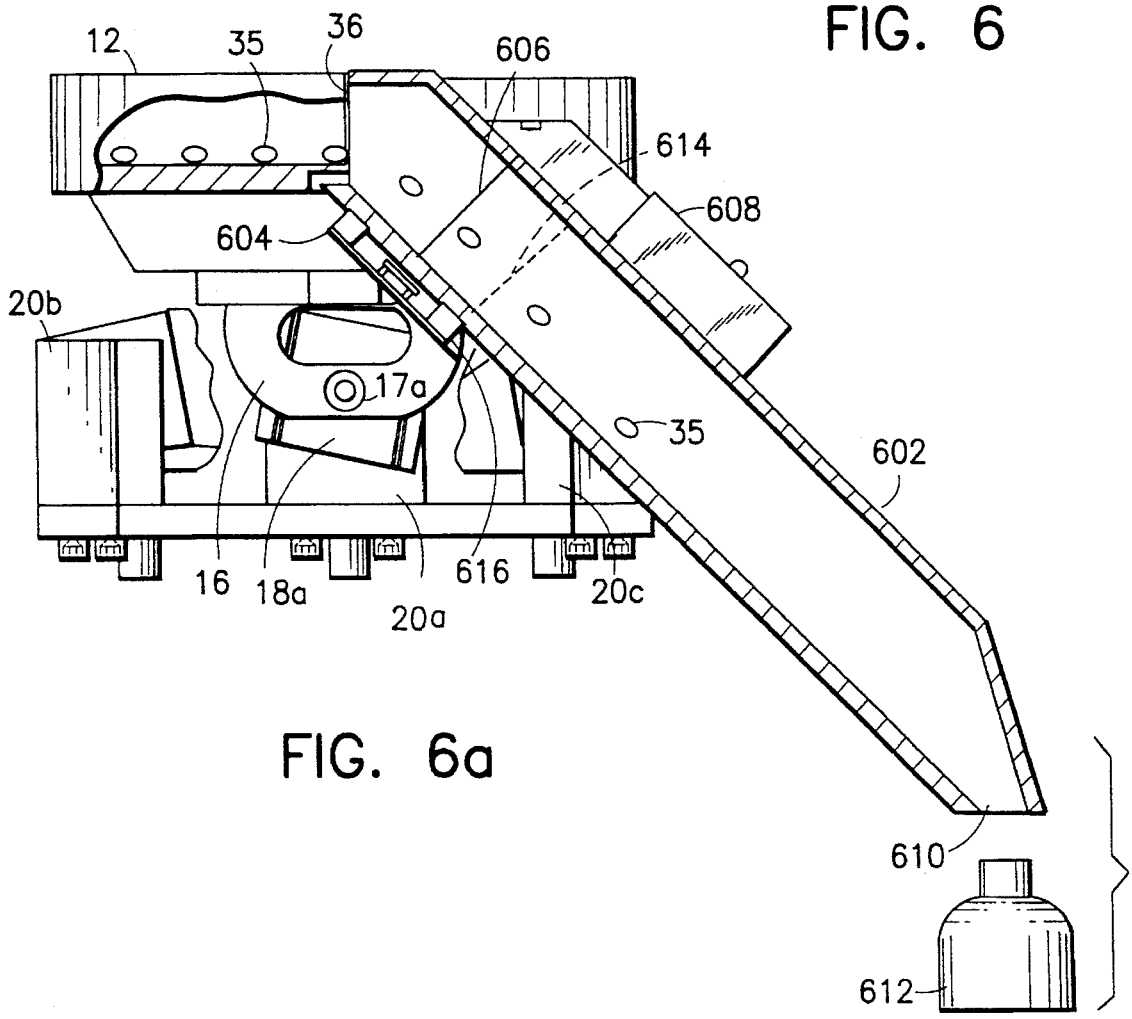
FIG. 6*a* is side elevation view in partial cross section of a counter section of the sorter/counter of FIGS. 5 and 6 [need a better figure]

As shown in FIG. 6*a*, pills 35 are vibrated upward and outward in bowl 12 to exit 36 whereupon they enter single file into an exit assembly (chute) 602. Exit assembly 602 is provided with a sensor array 604 beneath a light source 608 creating a sensing plane 606 which is defined by light passing from the light source to the sensor array. As pills 35 pass across the sensing plane 606 and through the path of light source 608, a shadow is cast on the sensor array 604 and the sensor array sends a signal to the microprocessor (described in detail below) which registers a count as described in more detail in the parent application hereof. Typically, the pills 35 continue their travel downward through the exit assembly 602, and through pill outlet 610, and enter a pill bottle 612 or other receptacle. A gate 614 may be provided to selectively block the outlet 610 to prevent more than a predetermined number of pills from falling into bottle 612, or to direct the pills down another chute (not shown) to another pill bottle (not shown). Gate 614 is preferably operated by a solenoid 616 controlled by the microprocessor circuit described below.

Figure 8A:
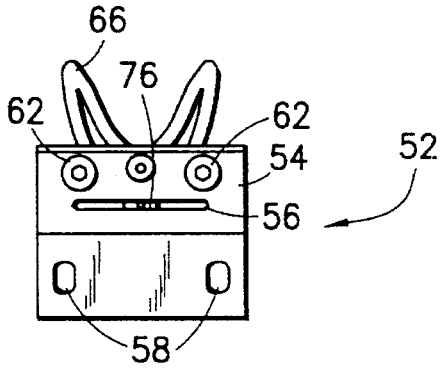
FIG. 8*a* is a front view of the photoelectric transducer according to the invention.
Figure 8B:
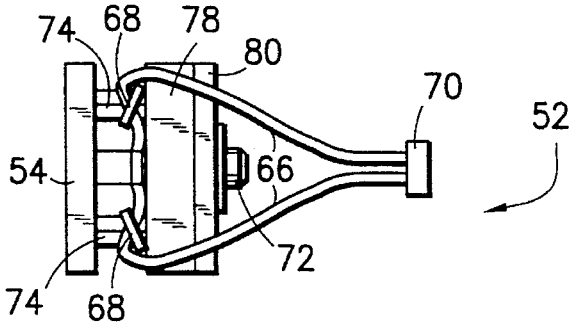
FIG. 8*b* is a top view of the transducer of FIG. 8*a;*
Figure 8C:
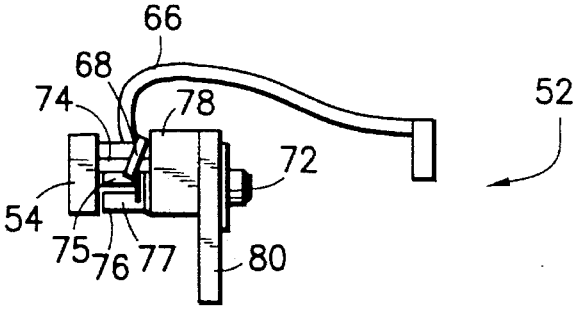
FIG. 8*c* is a side view of the transducer of FIGS. 8*a* and 8*b;*

Turning now to FIGS. 8*a*–8*c*, the photoelectric transducer 52 includes a front plate 54 having a horizontal shutter guide slot 56. Front plate 54 is coupled by Allen bolts 62 or the like through extension sockets 74 to a slide block 78. Slide block 78 is coupled to back plate 80 by set screw 72. Back plate 80 is provided with mounting bores 58 for receiving screws 54 for mounting the transducer to the inertia block 20*a* as described above. Optical sensor 76 includes a light source 75 and a light detector 77 which are arranged vertically with respect to horizontal shutter guide slot 56. The optical sensor thus provides a relatively thin beam of illumination which substantially bisects the guide slot 56. Cables 66 from the sensor 76 are tied to extension sockets 74 with wire ties 68. The cables 66 are preferably covered with shrink wrap and kept as close as possible to the slide block 78 to avoid damage during installation of the transducer. Cables 66 terminate in an electrical socket 70 for coupling the transducer to the calibration circuit described below.

Figure 9C:
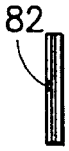
FIG. 9*c* is a front end view of the shutter of FIGS. 9*a* and 9*b;*
Figure 9A:
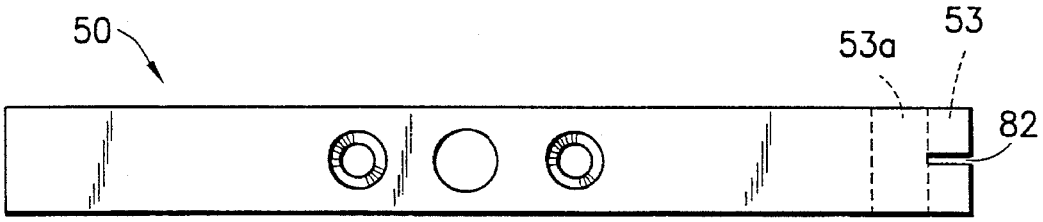
FIG. 9*a* is a top view of the shutter according to the invention.
Figure 9B:
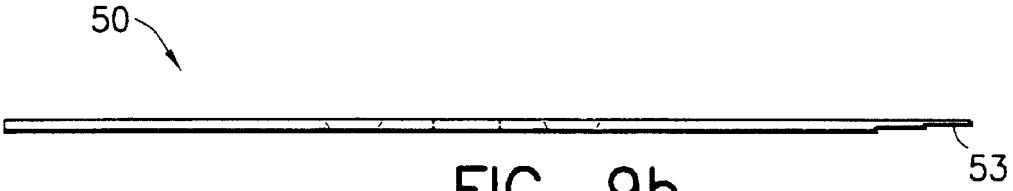
FIG. 9*b* is a side view of the shutter of FIG. 9*a;*

Turning now to FIGS. 9*a*–9*c*, it is seen that the shutter 50 of the invention is a relatively long and thin strip of stainless steel having a width of approximately 0.620 inches, a length of approximately 5.52 inches and a thickness of approximately 0.062 inches. One end 53 of the shutter is profiled slightly thinner than the remainder of the shutter and is provided with a narrow center slit 82 which is approximately 0.004 inches wide and approximately 0.25 inches long. The portion of the shutter containing the center slit 82 is approximately 0.030 inches thick and an adjacent portion 53*a* of the shutter extending approximately 0.3 inches from the end of center slit 82 has a thickness of approximately 0.057 inches. As mentioned briefly above, the end 53 of shutter 50 is dimensioned to fit inside the horizontal slot 56 of the transducer 52 with enough room to move horizontally approximately 0.25 inches either way while vertical movement is restricted. It will thus be understood by those skilled in the art that as the feed bowl 12 (FIGS. 5 and 6) vibrates, the shutter 50 oscillates such that the end 53 of the shutter having the center slit 82 moves back and forth horizontally within shutter guide slot 56 of the transducer 52. Moreover, it will be appreciated that horizontal movement of the narrow center slit 82 in the end 53 of shutter 50 interrupts the vertical beam of light between the light source 75 and the light detector 77.

Figure 10A:
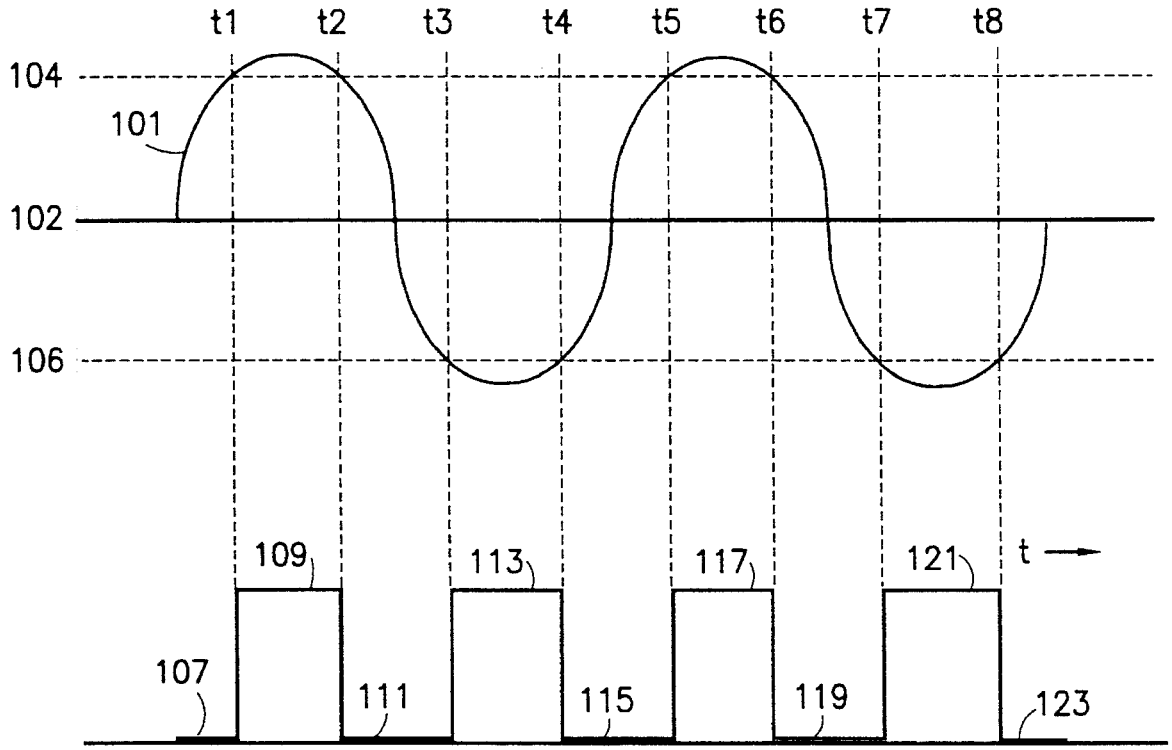
FIG. 10*a* is a graph showing the oscillatory movement of the shutter with respect to the transducer and the pulses generated when the centers of the shutter and transducer are aligned.
Figure 10B:
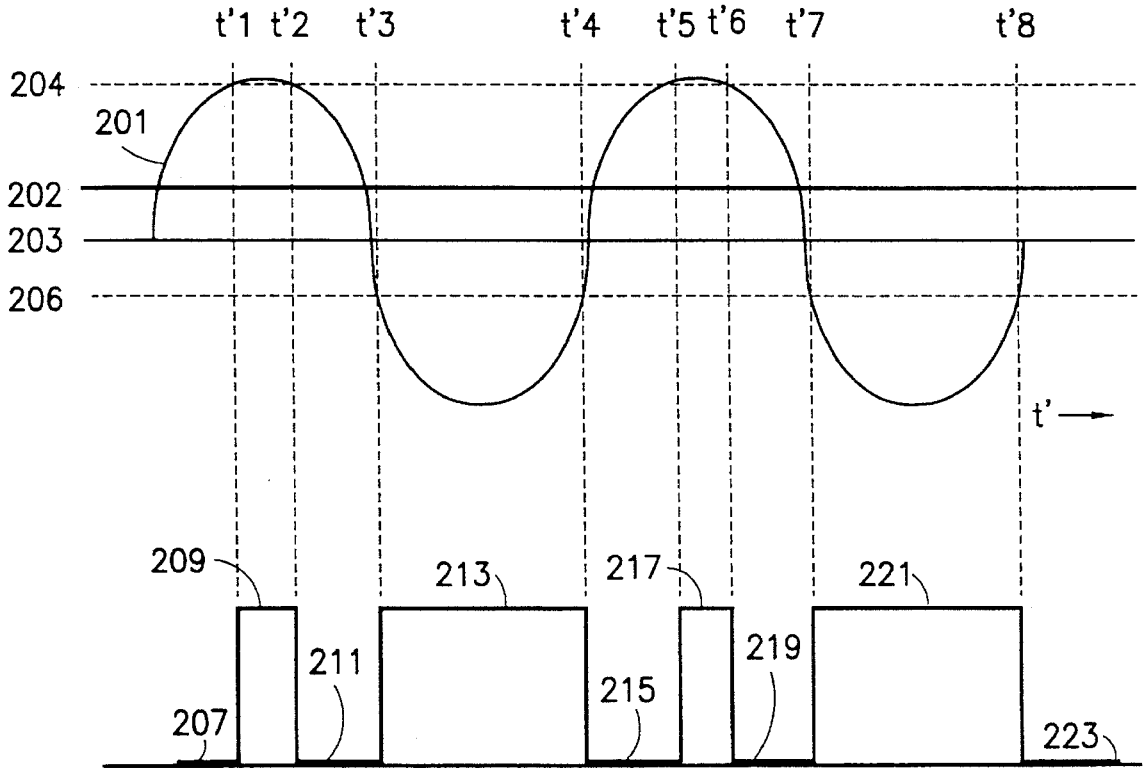
FIG. 10*b* is a graph similar to FIG. 10*a* but showing the relationship between shutter oscillation and pulses when the center of the shutter is not aligned with the center of the transducer.

FIGS. 10*a* and 10*b* are graphs which show examples of the kinds of pulses generated by transducer 52 in response to the oscillatory movement of shutter 50. Assuming that the center slit 82 of shutter 50 is perfectly aligned with the light source 75 and light detector 77 of transducer 52, and assuming that a circuit coupled to transducer 52 generates a positive voltage when the light from light source 75 is blocked from detection by light detector 77, a pulse will be generated every time the center slit 82 of shutter 50 moves sufficiently left or right relative to the transducer 52. FIG. 10*a* shows (in its upper portion) the movement of the shutter over time as a sinusoidal wave 101 about the center 102 of the transducer 52. The horizontal dotted lines 104, 106 indicate respective left and right positions of the shutter when the light from light source 75 is blocked. Points on the wave 101 which lie between the lines 104, 106 indicate positions of the shutter where the central slit 82 allows light to pass from source 75 to detector 77. Following the wave through time indicated by dotted vertical lines t1–t8, it will be seen that: prior to time t1 light is not blocked; between times t1 and t2, light is blocked; and after time t2, light is again not blocked (until time t3, and so on). The lower portion of FIG. 10*a* shows the pulses generated by the transducer resulting from the blocking and unblocking of light by shutter 50. It will be appreciated that as the shutter moves to the extreme left and right positions as indicated at time periods t1–t2, t3–t4, t5–t6, t7-t8, high pulses 109, 113, 117, 121 are generated. While the shutter is moving between extreme positions and light is not blocked as indicated by time periods t2–t3, t4–t5, t6–t7, low pulses 111, 115, 119 are generated. It will also be appreciated that the width of these pulses is inversely proportional to the amplitude of the oscillatory movement of the shutter, which in turn is proportional to the amplitude of the oscillatory movement of the feed bowl, which in turn is related to the feed rate of the counter/sorter. As shown in FIG. 10*a*, the width of both high and low pulses are constant for a constant amplitude so long as the centerline of the shutter is perfectly aligned with the centerline of the transducer when the shutter is at rest. In actual practice, however, the centerlines may not be aligned. FIG. 10*b* shows the relationship between shutter movement and pulse width when that is the case.

As aforementioned, FIG. 10*b* shows what happens when the rest position centerline 203 of the shutter is offset from the centerline 202 of the transducer. It will be seen that the apparent amplitude, as defined by the width of the high pulses, alternates because the distance the shutter must move in one direction to block the light is shorter than the distance the shutter must move in the opposite direction. For example, during time periods t'1–t'2, t'5–t'6, the shutter is in the extreme left position; but, since its centerline 203 is offset to the right of centerline 202 of the transducer, the high pulses 209, 217 are relatively narrow. Conversely, during time periods t'3–t'4, t'-t'8, the shutter is in the extreme right position and the high pulses 213, 221 are relatively wide. Nevertheless, as shown in FIG. 10*b* and as will be appreciated by those skilled in the art, even when the shutter centerline is not aligned with the transducer centerline, the time intervals between high pulses t'2–t'3, t'4–t'5, and t'6–t'7, will remain constant for a given amplitude of vibration and will result in a train of low pulses 211, 215, 219 which are uniform in width for a given amplitude. This relationship holds true so long as the respective centerlines of the shutter and transducer are offset by a relatively small amount. As mentioned above, the width of the low pulses is inversely proportional to the amplitude of the shutter motion for a given frequency. As amplitude increases, the width of the low pulses decreases. As amplitude decreases, the width of the low pulses increases. Thus, by comparing the width of low pulses generated by the transducer with the width of a reference pulse, the amplitude of the vibrations can be determined and adjusted accordingly. Those skilled in the art will also appreciate that not only are the widths of the low pulses constant for a given amplitude at a given misaligned sensor/shutter position, but that these widths change very little even if the resting shutter/sensor position changes from its initial position to a new position. In other words, for any given initial alignment and calibration at the factory, there is a significant window of tolerance within which the shutter/sensor position may vary and still yield the same pulse widths.

Figure 11:
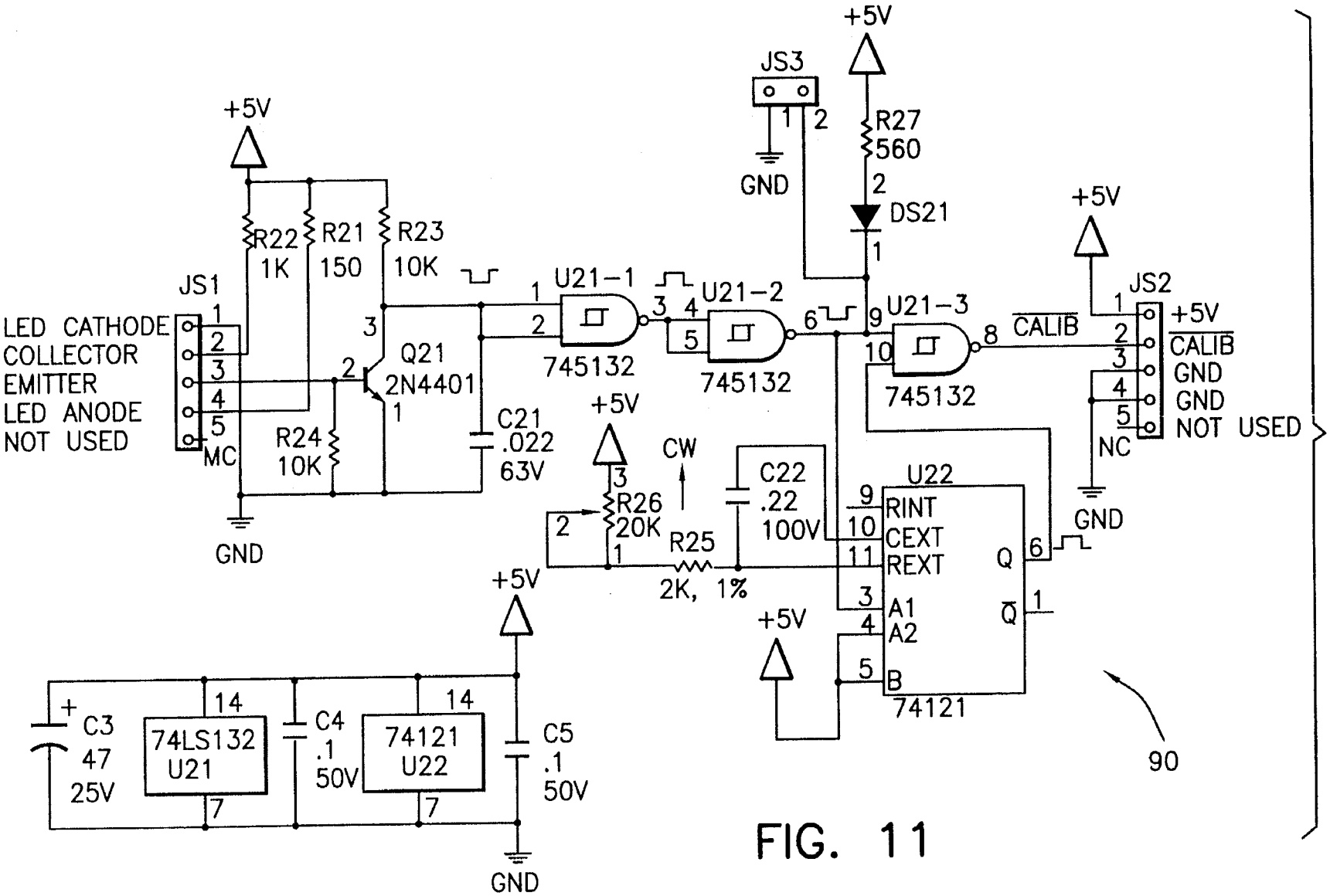
FIG. 11 is a schematic diagram of a calibration circuit according to the invention.

FIG. 11 shows a schematic diagram of a circuit 90 used to generate a reference pulse and compare it to pulses generated by the transducer in order to provide an output which indicates whenever the amplitude of bowl vibration exceeds a calibration set point. Jack JS1 couples this circuit to the photoelectric transducer described above. Resistors R21, R22, R23, R24, capacitor C21, and transistor Q21 power the transducer and generate a low pulse when light is allowed to pass through the shutter as described above. The low pulses are fed to integrated circuit U21 which comprises a series of NAND gates (U21-1, U21-2, and U21-3). An adjustable RC circuit R25, R26, C22 controls the width of a reference pulse generated by a monostable multivibrator one-shot U22. Low pulses from Q21 are fed to NAND gate U21-1 which squares and inverts the pulses. NAND gate U21-2 inverts the pulses to low again. High pulses from U22 are triggered by low pulses from U21-2 and are compared at U21-3. The CALIB output of U21-3 is low whenever the width of a pulse from U21-2 is narrower than the width of reference pulse from U22 indicating that the amplitude of feed bowl vibration exceeds the value set at R26. The CALIB output is coupled to a microprocessor circuit (described below) by jack JS2. An LED indicator DS21 may be provided to indicate when the center slit of the shutter is aligned with the transducer so that the position of the shutter can be centered during assembly. Jack JS3 provides an auxiliary output for a remote indicator used in research and development to debug the system.

Figure 12:
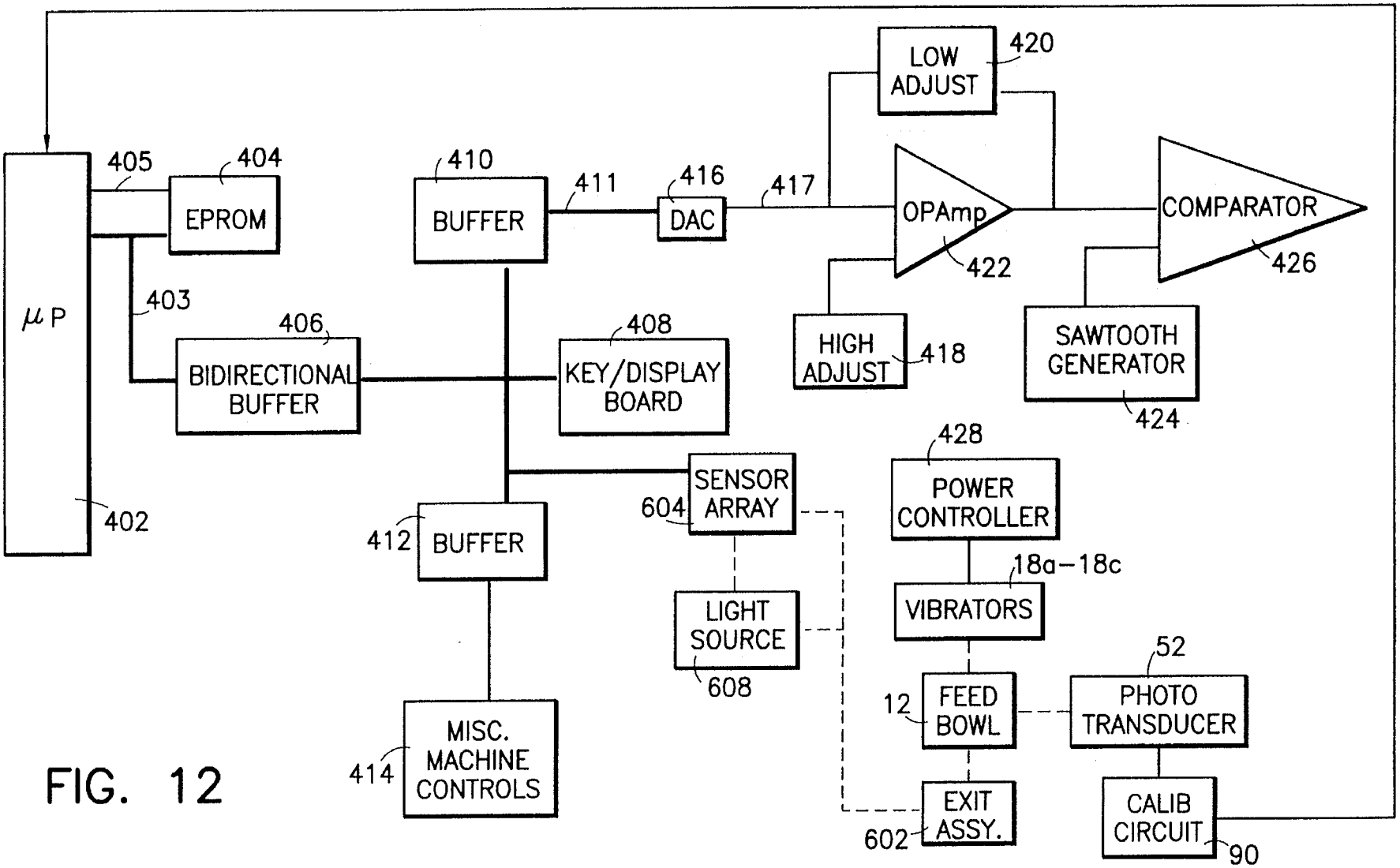
FIG. 12 is a schematic block diagram of a microprocessor control circuit for monitoring and adjusting the feed rate of the sorter/counter.

FIG. 12 shows a block diagram of a microprocessor control circuit for controlling operation of the sorter/counter. In the preferred embodiment, an eight bit microprocessor 402 is coupled to a program EPROM 404 through an eight bit data bus 403 and through an address bus 405. The microprocessor 402 is also coupled to a keyboard/display 408 (for entering parameters, testing, and operation of the sorter/counter) and receives input signals from the CALIB output of the calibration circuit 90 described above with reference to FIG. 11 and the sensor array 604 described above with reference to FIG. 6*a*. The EPROM 404 contains instructions (which will be described in detail below) for the microprocessor to operate the sorter/counter and control most of its functions including the setting of a feed rate at start-up, and the maintaining of a constant feed rate once feed rate can be determined by the microprocessor as a result of sensing by the optical sensors. Signals provided by the transducer 52 and settings provided by the keyboard 408 are acted upon by the program in EPROM 404 as implemented by the microprocessor 402. One result of the microprocessor's implementation of the program is a "control byte" placed on the data bus 403 which is used to control power delivered to the vibrators. The control byte passes through bidirectional buffer 406 and is passed to buffer 410 via data bus 407. Buffer 410 passes the control byte via bus 411 to a digital to analog converter 416 which outputs a control current at 417 to an operational amplifier 422. OpAmp 422 is supplied with potentiometer circuits 418, 420 for high and low adjustment during manufacture in order to relate the specific operational dynamics of a particular unit to the control byte. These adjustments are made only once in the factory to calibrate a high and low control byte with a high and low amplitude of vibration. The output 423 of OpAmp 422 is a control voltage which is supplied to a comparator 426 for comparison with a sawtooth wave from sawtooth generator 424. When the sawtooth voltage exceeds the control voltage, the comparator output goes high. The output of the comparator 426 is coupled to a power controller 428 via an optocoupler/high voltage isolator (not shown) to control the duty rate of the pulses supplied to vibrators 18*a*–18*c*.

It should be noted that the microprocessor, via buffer 412, is also used to control other machine functions 414 such as turning the counter/sorter on and off, operating gate 614 through solenoid 616 (FIG. 6*a*), and activating conveyors, fans, etc. not shown.

Figure 13A:
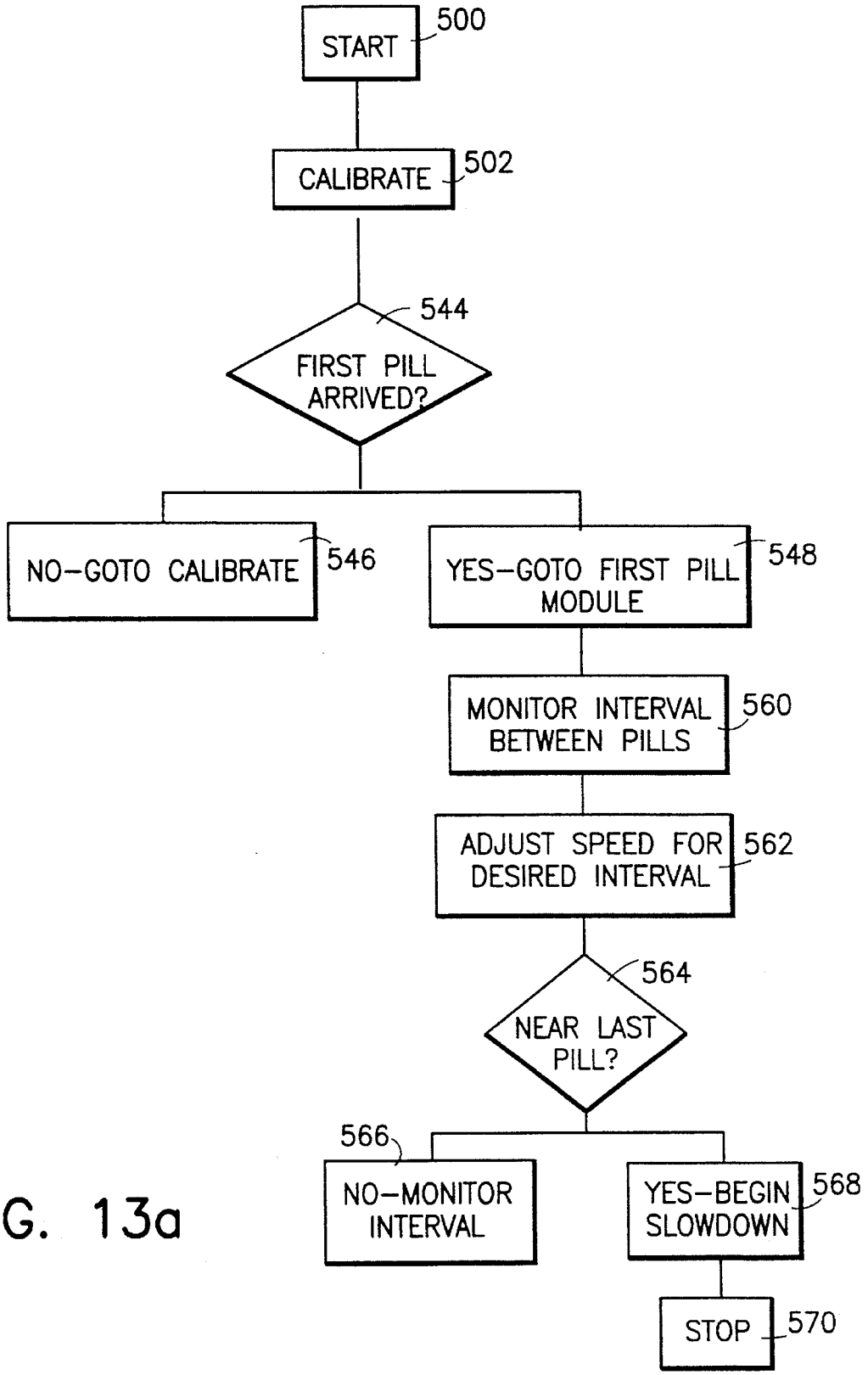
FIGS. 13*a*–13*c* are simplified flow charts of the program used by the microprocessor of FIG. 12.
Figure 13B:
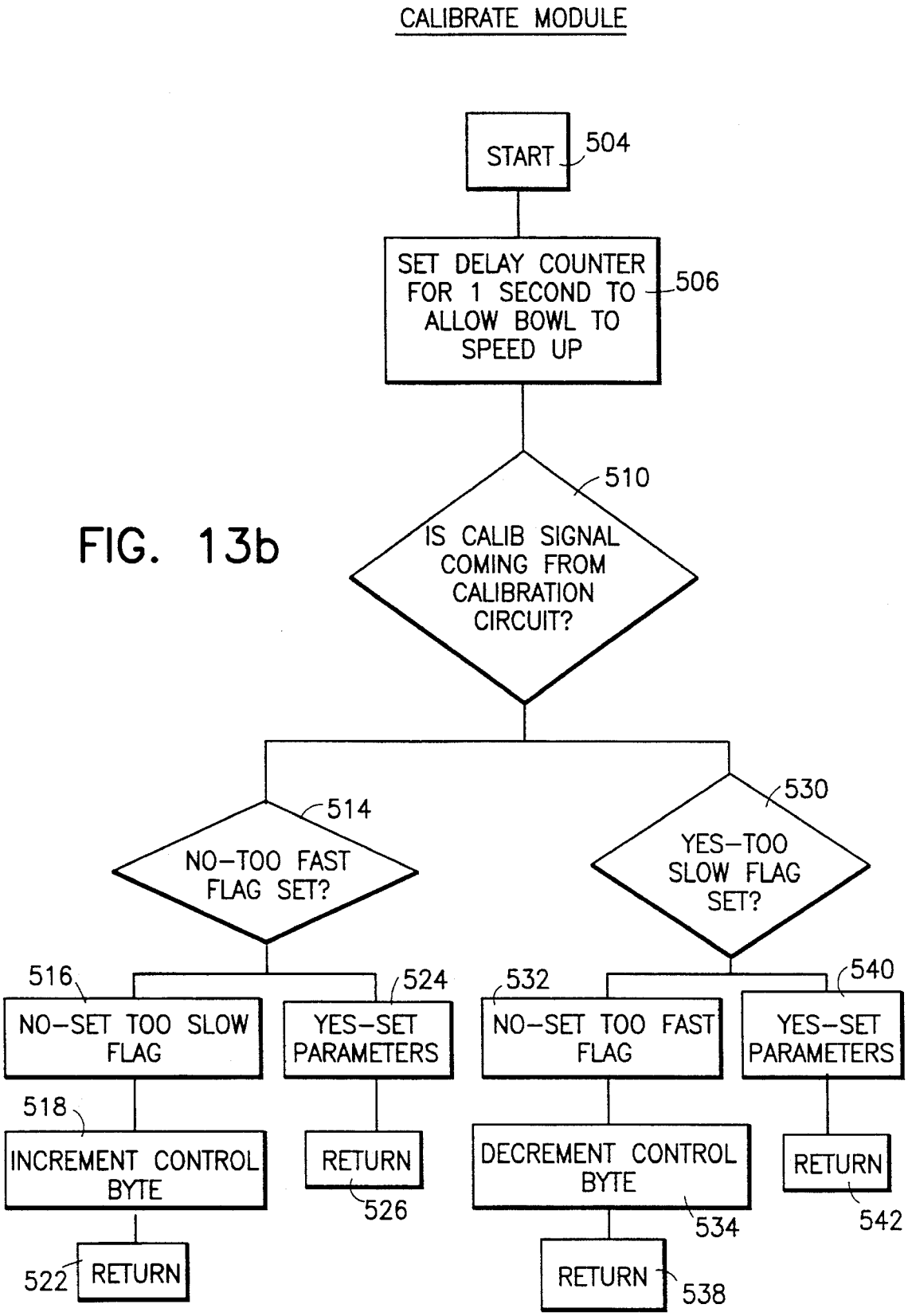
Figure 13C:
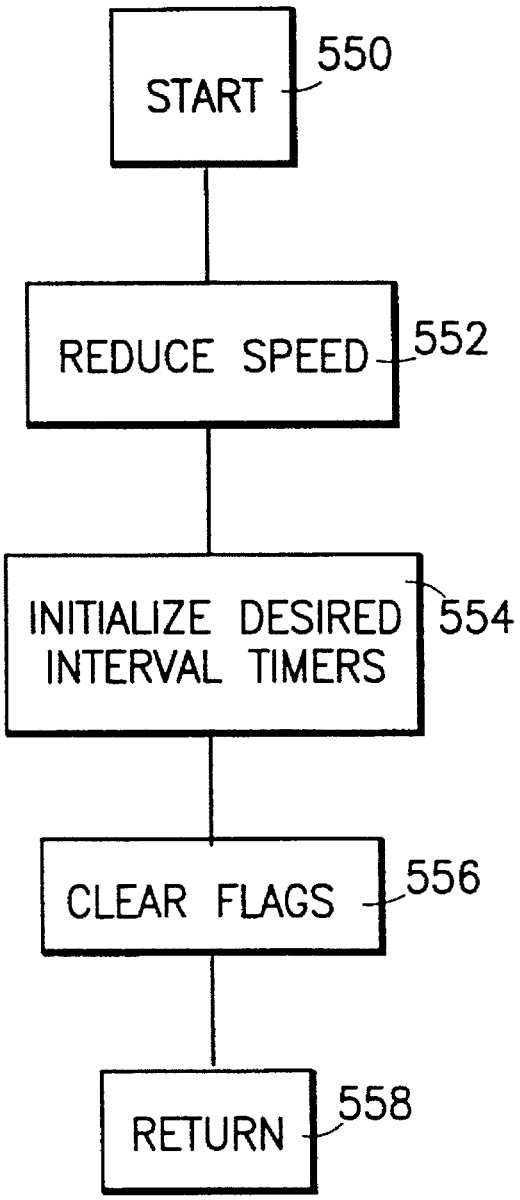

The operation of the circuit described with reference to FIG. 12 will be better understood by reference to the program instructions stored in EPROM 404. FIGS. 13*a*–13*c* are simplified flow charts of those program instructions followed by microprocessor 402 in controlling the sorter/counter. The preferred programming of the microprocessor is in assembly language and comprises several modules which are called by a control module. A simplified flow chart of the control module is shown in FIG. 13*a*. FIG. 13*b* shows a simplified flow chart of the calibrate module called by the control module, while Figure 13*c* shows a simplified flow chart of the first pill module called by the control module. Other modules may be used and the modules shown are vastly simplified in order to show an overall view of how the microprocessor controls the feed rate of the sorter counter.

Turning now to FIGS. 13*a*, when the sorter/counter is started at 500, and after other parameters (not shown), including the amount of pills to be counted and the desired feed rate, have been checked and set, the calibrate module is run at 502.

As seen in FIG. 13*b*, the calibrate module starts at 504 and sets a delay counter for one second at 506 to allow the bowl to vibrate up to speed. It will be recalled that a target vibration amplitude of the bowl is set on the calibration circuit (FIG. 11) and the CALIB output from that circuit to the microprocessor indicates each time that target amplitude has been exceeded. If the CALIB signal from the calibration circuit is present, indicating that the bowl is vibrating above the target rate, the calibrate module looks at 530 to see if the "too slow flag" was set earlier. If the "too slow flag" is set, indicating that a too slow to too fast transition has been detected, then the parameters critical to controlling bowl amplitude are set at 540 and the program returns to the control module at 542. If the "too slow flag" was not previously set, a "too fast flag" is set at 532. The control byte is decremented a predetermined amount at 534 and the calibrate module returns to the control module at 538. If, at 510, it was determined that the CALIB signal was not present, the calibrate module looks at 514 to see if the "too fast flag" had previously been set. If it had, indicating a too fast to too slow transition, parameters are set at 524 and the control module is resumed at 526. If the "too fast flag" was not set, the "too slow flag" is set at 516, and the control byte is incremented at 518. The control module is then resumed at 522. It will thus be appreciated that each time a transition about the target amplitude is detected, an interpolation of parameters takes place and this process continues until the arrival of the first pill (544 in FIG. 13*a*).

Upon return from the calibrate module, the control module (FIG. 13*a*) looks at 544 to see if the first pill has arrived. It will be recalled that sensor array 604 in FIG. 6*a* registers whenever a pill crosses the sensing plane 606. The first time this happens, a flag is set by the microprocessor to indicate that the first pill has arrived. If the control module determines that the first pill has not yet arrived, it returns at 546 to the calibrate module (FIG. 13*b*) for further adjustment of parameters as described above. If the first pill has arrived, the control module executes a "first pill module" at 548.

The first pill module starts at 550 as shown in FIG. 13*c*. It will be recalled that one of the objects of the invention is to deliver the first pill in a timely but controlled fashion and to maintain a constant feed rate thereafter. In accord with that object, upon the sensing of a first pill, the first pill module immediately reduces the amplitude of vibration 552 to a preset amplitude corresponding to a desired feed rate based on parameters such as the type of pills being counted, the number of pills to be counted, etc. Then, the first pill module initializes one or more timers at 554 to monitor the time interval between the arrival of pills which is an indication of feed rate. All of the flags set by the calibrate module are also cleared at 556, and the control module of FIG. 13*a* is resumed at 558.

After the first pill module is completed, the control module of FIG. 13*a* monitors the arrival of pills at 560 and adjusts the vibration amplitude up or down at 562 to maintain a constant feed rate. Based on a preset number of pills to be counted, the control module keeps track of the pills delivered and checks that amount at 564 to determine if the pill count is within a preset number of the final count. If it is, the control module slows the feed rate at 568 so that action can be taken to prevent further delivery of pills beyond the selected count. This usually involves obstructing the pill outlet 610 in FIG. 6*a* by interposing a gate such as gate 614 which is operated by solenoid 616 activated by the microprocessor after the selected pill count is reached. However, it is preferable to slow the feed rate near the end of the pill count so that the gate can be interposed before additional pills pass through the pill outlet 610. After the preselected pill count has been delivered to the bottle 612 in FIG. 6*a*, the control module stops the vibration of the machine at 570.

There have been described and illustrated herein certain methods and devices for controlling the feed rate of an object sorter/counter. While particular embodiments of the invention have been described, it is not intended that the invention be limited thereto, as it is intended that the invention be as broad in scope as the art will allow and that the specification be read likewise. Thus, while particular dimensions, locations, and configurations of a feed bowl, shutter, mounting tripod, and vibrators have been disclosed, it will be appreciated that other dimensions, locations, and configurations could be utilized. Also, while certain circuits have been shown to provide pulse trains and reference pulses to determine the amplitude of vibration, it will be recognized that other types of circuits could be used with similar results obtained. Moreover, while particular configurations have been disclosed in reference to a microprocessor and certain software for use therewith, it will be appreciated that other types of processors and variations in the disclosed software could be used as well. Furthermore, while the counter section with sensor array and gate has been disclosed as having certain dimensions, locations, and configurations, it will be understood that different dimensions, locations, and configurations can achieve the same or similar function as disclosed herein. It will therefore be appreciated by those skilled in the art that yet other modifications could be made to the provided invention without deviating from its spirit and scope as so claimed.

I claim:

1. An apparatus for counting discrete objects comprising:

a) an object feeder for feeding objects to be counted, said object feeder having an output opening;

b) adjustable amplitude oscillating means coupled to said object feeder for oscillating said object feeder at an amplitude to align said objects in said feeder whereby said objects exit said output opening substantially one at a time;

c) receiving means coupled to said output opening of said object feeder for receiving said objects from said output opening;

d) first sensor means adjacent said receiving means for registering each of said objects received by said receiving means;

e) counting means for counting each of said objects;

f) second sensor means coupled to said object feeder for sensing the amplitude of oscillation of said object feeder; and g) control means coupled to said adjustable amplitude oscillating means and coupled to said first and second sensor means for controlling said amplitude of oscillation of said object feeder, wherein said control means adjusts said adjustable amplitude oscillating means to oscillate said object feeder at a first predetermined amplitude greater than zero until said first sensor means registers a first object received by said object receiver after which said control means adjusts said adjustable amplitude oscillating means to oscillate said object feeder at a second predetermined amplitude greater than zero, said second predetermined amplitude being less than said first predetermined amplitude.

2. An apparatus according to claim 1, further comprising:

h) timing means coupled to said control means for determining when in time said first sensor means registers each of said objects received by said object receiver, wherein said control means monitors when in time each of said objects is registered by said first sensor means, calculates an interval between registration of objects and adjusts said adjustable amplitude oscillating means to oscillate said object feeder to effect a constant feed rate.

3. An apparatus according to claim 2, further comprising:

i) controllable gate means coupled to said object receiver for selectively blocking said object path to prevent objects from passing through said object receiver, said gate means coupled to said control means, wherein said counting means is coupled to said control means for counting the number of objects registered by said first sensor means, said control means adjusts said adjustable amplitude oscillating means to oscillate said object feeder at a third predetermined amplitude when said counting means registers a count which is a predetermined number less than a preset maximum number, said third predetermined amplitude being less than said second predetermined amplitude, and said control means controls said controllable gate means to block said object path when said counting means registers a count which is equal to said preset maximum number.

4. An apparatus according to claim 1, wherein said first sensor means comprises a light source and a photodetector.

5. An apparatus according to claim 1, wherein:

said second sensor means comprises a light source and a photodetector and a shutter coupled to said object feeder, and said shutter is movably interposed between said light source and said photodetector such that light from said light source is intermittently detected by said photodetector when said object feeder oscillates.

6. An apparatus according to claim 5, wherein:

said shutter has a central slit for allowing light to pass from said light source to said photodetector when said shutter is in a central position.

7. An apparatus according to claim 6, wherein:

said second sensor means includes a circuit means for generating a series of oscillation pulses, said pulses having widths related to the amplitude of oscillation of said object feeder.

8. An apparatus according to claim 7, wherein:

said second sensor means includes a circuit means for generating a series of reference pulses, said reference pulses each having a width related to said first predetermined amplitude, and a comparator means for comparing the width of said reference pulses to the widths of said oscillation pulses to determine when said object feeder is oscillating at said first predetermined maximum amplitude.

9. An apparatus according to claim 1, wherein:

said first sensor means comprises photoelectric sensor means including a light source and a light detector, said source and detector being spaced apart;

said second sensor means comprises shutter means coupled to said oscillating feeder and interposed between said source and detector; and said control means comprises, i) first pulse generating means coupled to said second sensor means for generating a series of oscillation pulses, said oscillation pulses having widths proportional to said amplitude of oscillation of said feeder, ii) second pulse generating means for generating a train of reference pulses, said reference pulses having widths proportional to a reference amplitude, iii) first comparator means coupled to said first and second pulse generating means for comparing the widths of oscillation and reference pulses, and iv) first control means coupled to said vibrator and responsive to said comparator means for adjusting the amplitude of said adjustable amplitude vibrator.

10. An apparatus according to claim 9, wherein:

said shutter means has a central slit permitting light from said source to pass through said slit to said detector when said shutter means is in a central position;

said first pulse generating means generates said oscillation pulses when light from said source is blocked by said shutter means; and said photoelectric sensor means includes a limiting sleeve surrounding a portion of said shutter means to limit movement of said shutter means.

* * * * *